United States Patent [19]

Wanat et al.

[11] Patent Number: 5,028,911

[45] Date of Patent: Jul. 2, 1991

[54] ACOUSTICALLY RESPONSIVE PORTABLE EMERGENCY LIGHT

[75] Inventors: David J. Wanat, Meriden; Robert Osit, Shelton, both of Conn.

[73] Assignee: Black & Decker, Inc., Newark, Del.

[21] Appl. No.: 483,701

[22] Filed: Feb. 23, 1990

[51] Int. Cl.[5] ..... G08B 7/00; G08B 17/10; F21V 23/04

[52] U.S. Cl. ..... 340/691; 340/326; 340/531; 340/628; 340/693; 362/191; 362/394

[58] Field of Search ..... 340/628, 691, 693, 326, 340/540, 531; 200/61.59, 61.58 R; 362/394, 191, 190

[56] References Cited

U.S. PATENT DOCUMENTS 4,258,291 3/1981 Scott et al. ..... 340/326
4,432,041 2/1984 Pfisterer et al. ..... 340/531
4,617,561 10/1986 Brown ..... 340/628

*Primary Examiner*—Glen R. Swann, III
*Attorney, Agent, or Firm*—Barry E. Deutsch

[57] ABSTRACT

A portable light includes a light, a battery, and a switch having an "on" position and an "off" position. The switch in the "off" position prevents the light from being illuminated and the switch in the "on" position directly connects the light to the battery to cause the light to be illuminated. The switch includes a first interdigitating member. A bracket for mounting the portable light includes a second interdigitating member in interconnecting relationship with the first interdigitating member on the switch. The interconnecting relationship between the interdigitating member moves the switch to the "on" position when the light is removed from the bracket.

3 Claims, 1 Drawing Sheet

FIG. 1
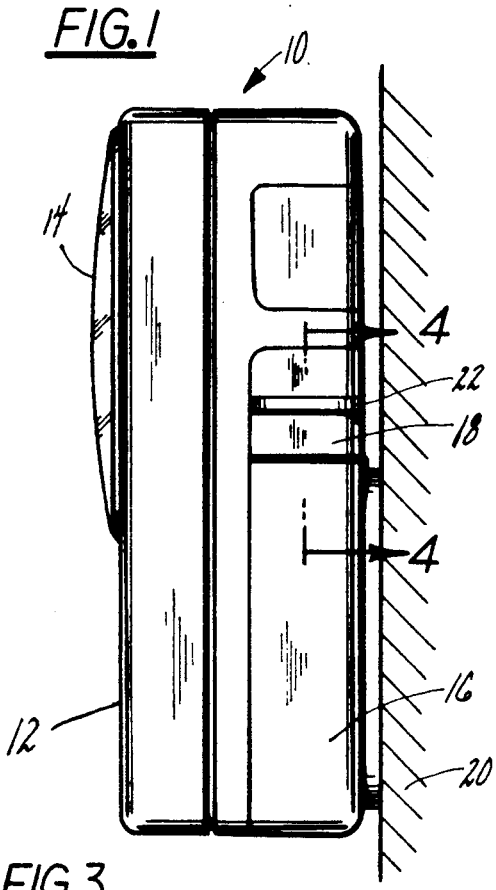
FIG. 2
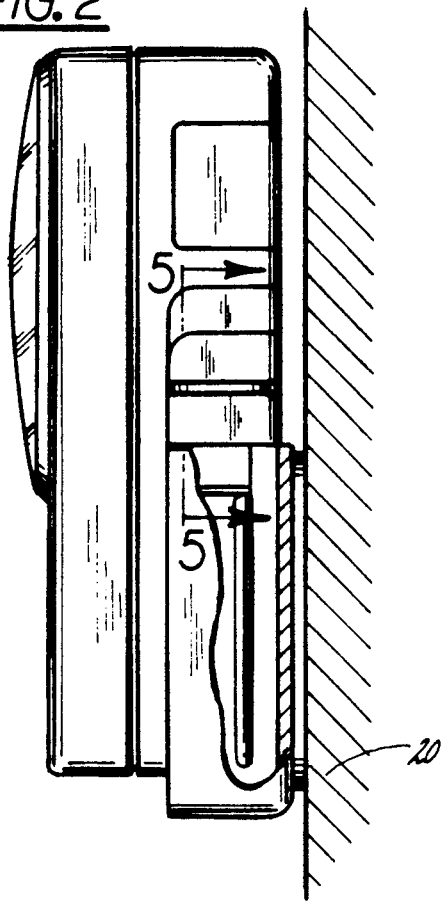
FIG. 3
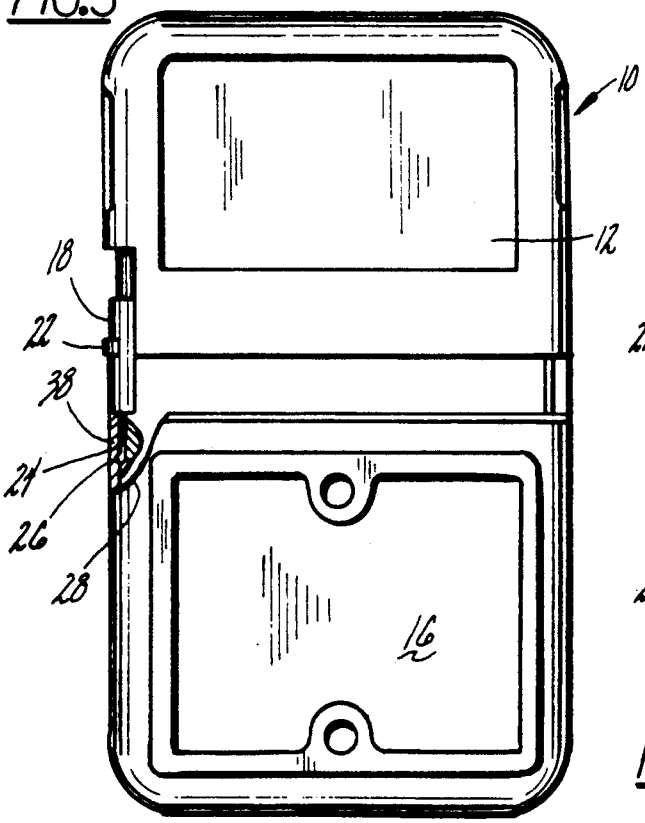
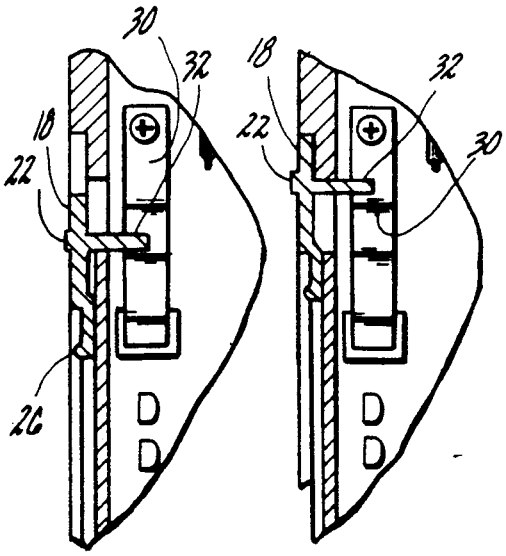
FIG. 5 FIG. 4

ACOUSTICALLY RESPONSIVE PORTABLE EMERGENCY LIGHT

BACKGROUND OF THE INVENTION

This invention relates generally to portable lights, and more particularly to lights which are automatically placed in an operating mode when removed from a mounting bracket.

The use of smoke and fire detectors in homes and apartments have become increasingly common and in some locales, are required to meet building codes for new homes and apartment construction. Very often, several of these detectors are provided throughout the home or apartment. When fire or smoke is detected, the device emits a relatively loud alarm for warning the occupants of the residence of the existance of the fire or smoke. If the occupants are sleeping, the alarm is sufficiently loud and harsh to alert the persons to danger.

In the event that the fire has progressed, it is not unlikely that the lights powered by the main electrical system of a residence will be inoperative. More likely, the residence may be filled with an appreciable quantity of smoke so the occupants may be disoriented and find it difficult to escape from a dark, smoke filled area. The darkness problem created by smoke will be compounded if a fire occurs during the evening hours.

Emergency escape lights that automatically turn on in the event an alarm condition arises exist in the prior art. While some of these lights are integrally designed to smoke or fire detecting units or are physically wired to a fire alarm or smoke detecting system, others of these lights are portable and self contained. The portable lights are generally held in a mounting bracket which in turn is affixed to a wall or similar member.

The switch controlling operation of the prior art light generally has three functions, an on function, an off position, and an automatic function. The on function actuates the light. The off function deactivates the light and the automatic function enables the light to be activated in response to transmission of an audible sound from the smoke or fire detectors.

When the light is removed from its mounting bracket, it is almost always desired by the user that the light be or remain illuminated.

An example of such a light is illustrated in U.S. Pat. No. 4,258,291 issued to Robert J. Scott et al on Mar. 24, 1981. This patent illustrates a switch operator which is held in a retracted position when the light is mounted in its bracket. When the light is removed from its bracket the switch operator moves to an extended position allowing the switch to close. The arrangement illustrated in the Scott et al patent introduces an intervening member i.e. the switch operator, between the switch and bracket. If the operator is disabled, the switch may not close upon removal of the light from its bracket.

Accordingly, it is an object of the present invention to interconnect the switch of the light and the mounting bracket so that the light is illuminated when the light is removed from the mounting bracket.

SUMMARY OF THE INVENTION

The foregoing object and other object of the invention are attained in a portable light comprising light means; battery means; and switch means having on and off functions, the off function of said switch means preventing said light from being illuminated, said switch means including first interdigitating means; and a bracket for mounting said portable light, said bracket including second interdigitating means in interconnecting relationship with said first interdigitating means on said switch means, said interconnecting relationship placing said switch means in said on function when the light is removed from said bracket.

BRIEF DESCRIPTION OF THE DRAWING

FIG. 1 is side elevational view of a light in accordance with the present invention held in its mounting bracket;

FIG. 2 is a view similar to FIG. 1 with the light partially removed from its mounting bracket;

FIG. 3 is a rear elevational view of the light, with a portion broken away to illustrate a detail of the present invention;

FIG. 4 is a sectional view taken along line 4—4 of FIG. 1; and

FIG. 5 is a sectional view taken along line 5—5 of FIG. 2.

DESCRIPTION OF THE PREFERRED EMBODIMENT

Referring now to the various figures of the drawing, the preferred embodiment of the present invention shall be described. In referring to the various figures, like numerals shall refer to like parts.

Referring specifically to FIGS. 1 and 2, there is illustrated a portable light 10. Light 10 includes housing 12 which is preferably formed from a suitable plastic material. A lens 14 formed from suitable transparent material such as glass or plastic is mounted in the front of housing 12. A bulb (not shown) is mounted behind the lens in a typical manner to emit light.

Light 10 is generally held within a mounting bracket 16 which is affixed to a wall or similar support member 20. Switch 18 is positioned in vertical axial alignment with mounting bracket 16. Switch 18 has 2 positions, the first of which is an AUTO/OFF position and the second of which is an ON position. When light 10 is mounted within mounting bracket 16, switch 18 is physically moved into its AUTO/OFF position. This position is illustrated in FIG. 1.

Switch 18 includes an upstanding portion 22 which can when the light is partially removed from its mounting bracket 16 be manipulated by the user of light 10 to move switch 18 from the position illustrated in FIG. 1 to the position illustrated in FIG. 2. Switch 18 further includes an extension piece 24 which terminates in a raised portion 26 defining a first interdigitating means.

The wall 38 of bracket 16 overlying extension piece 24 includes an indented portion 28 which is aligned with and engaged by raised portion 26 of the switch 18. Indented portion 28 of bracket wall 38 defines a second interdigitating means. The first and second interdigitating means 26, 28 are positioned in interconnecting relationship whereby relative movement between bracket 16 and switch 18 results in movement of the switch.

FIGS. 1 and 4 illustrate the position of the switch in its AUTO/OFF functions position and FIGS. 2, 3 and 5 illustrate the position of the switch and bracket when the light has been partially removed from the bracket and the switch is in its ON function position. It will be note that switch 18 has been moved downwardly by the interconnection between indented portion 28 of bracket 16 and raised portion 26 of switch 18. The movement on the switch places the switch in an "ON" state. Switch 18 includes an inwardly extending portion 32 which extends over electrical contact 30. As switch 18 moves downwardly, portion 32 of switch 18 moves electrical contact 30 into electrical connection with a second electrical contact (not shown) for connecting the batteries of the light to the bulb.

Light 10 is particularly designed to be placed into a light emitting state when the switch is in its AUTO function position in response to a detected sound emitted from a smoke or fire detector. Details of the electrical circuitry which performs the automatic function described above are set forth in a co-pending application Ser. No. 07/483,700 Filing Date Feb. 23, 1990 filed in the names of Charles Griebell and Christie Petrides and assigned to Black & Decker, Inc., the same assignee as the assignee hereof.

As noted previously, switch 18 can be manipulated by the user of light 10 or can be moved in response to movement of the light relative to its mounting bracket 16 when interdigitating means 26, 28 of the switch and bracket respectively are in interconnecting relationship.

By providing the interengagement between the bracket and the switch, the user of light 10 is ensured that the light will be placed in an ON mode immediately upon its removal from its mounting bracket irrespective of whether a special audible alarm signal is being emitted.

While a preferred embodiment of the present invention has been described and illustrated, the invention should not be limited thereto, but may be otherwise embodied within the scope of the following claims.

We claim:

1. A smoke-alarm-activated portable light comprising:

sound receiving means for generating an electrical output signal in response to the specific audible alarm emitted from said smoke alarm;

light means;

battery means;

means for receiving said electrical output signal for electrically connecting said batter means and said light means to cause said batter means to illuminate said light means in response to transmission of said electrical output signal;

switch means having "on," and automatic/off positions, said switch means in the automatic/off position enabling said means for electrically connecting to cause said battery means to illuminate said light means in response to said electrical output signal, but otherwise preventing said light means from being illuminated, said switch means in the "on" position directly connecting said light means to said battery means to cause said light means to be illuminated; and a bracket for mounting said portable light, said bracket moving said switch means to the "on" position when said portable light is removed from said bracket.

2. A smoke-alarm-activated portable light in accordance with claim 1 wherein said bracket includes first interdigitating means, and said switch means includes second interdigitating means in interconnecting relationship with said first interdigitating means, said interconnecting relationship moving said switch means to said "on" position when the light is removed from said bracket.

3. A portable light comprising:

light means;

battery means;

switch means having an "on" position and an "off" position, said switch means in the "off" position preventing said light from being illuminated, and said switch means in the "on" position directly connecting said light to said battery to cause said light to be illuminated, said switch means including first interdigitating means; and a bracket for mounting said portable light, said bracket including second interdigitating means in interconnecting relationship with said first interdigitating means, said interconnecting relationship moving said switch means to said "on" position when the light is removed from said bracket.

* * * * *